US007086161B2

(12) United States Patent
Ellig et al.

(10) Patent No.: US 7,086,161 B2
(45) Date of Patent: Aug. 8, 2006

(54) SIGHT AND SIGHT PINS FOR ARCHERY BOW

(75) Inventors: Michael Ellig, Gallatin, MT (US); Jeff Murray, Saint Louis, MN (US)

(73) Assignee: Montana Black Gold, Bozeman, MT (US)

( * ) Notice: Subject to any disclaimer, the term of this patent is extended or adjusted under 35 U.S.C. 154(b) by 0 days.

(21) Appl. No.: 10/755,941

(22) Filed: Jan. 13, 2004

(65) Prior Publication Data

US 2005/0150119 A1 Jul. 14, 2005

(51) Int. Cl.
*F41G 1/467* (2006.01)
*F41G 1/32* (2006.01)

(52) U.S. Cl. ..... 33/265; 127/87

(58) Field of Classification Search ..... 33/265; 124/87

See application file for complete search history.

(56) References Cited

U.S. PATENT DOCUMENTS

| | | | | |
|---|---|---|---|---|
| 4,166,324 | A * | 9/1979 | Carollo et al. | 42/132 |
| 4,495,705 | A * | 1/1985 | Kowalski et al. | 33/265 |
| 4,620,372 | A * | 11/1986 | Goodrich | 33/265 |
| 4,813,150 | A * | 3/1989 | Colvin | 33/265 |
| 5,048,193 | A * | 9/1991 | Hacquet | 33/265 |
| 5,094,002 | A * | 3/1992 | Saunders | 33/265 |
| 5,862,603 | A * | 1/1999 | Ellig | 33/265 |
| 6,247,237 | B1 * | 6/2001 | Redburn et al. | 33/265 |
| 6,418,633 | B1 * | 7/2002 | Rager | 33/265 |
| 6,446,347 | B1 * | 9/2002 | Springer | 33/265 |
| 6,581,317 | B1 * | 6/2003 | Slates | 42/132 |
| 6,796,037 | B1 * | 9/2004 | Geffers et al. | 33/265 |
| 2002/0083602 | A1 * | 7/2002 | Slates | 33/265 |

* cited by examiner

*Primary Examiner*—Diego Gutierrez
*Assistant Examiner*—Amy R. Cohen
(74) *Attorney, Agent, or Firm*—Blackwell Sanders Peper Martin, LLP

(57) ABSTRACT

A device used to facilitate the accurate shooting of an archery bow. The device includes horizontally and vertically adjustable support structure for attaching the device to a bow. Moreover, the device includes a base, a guard and sight pins. The base includes arcuate channels sized for receipt of sight pins and arched to ensure that the sight pins are aimed at the archer's eye regardless of vertical spacing. The sight pins include an offset-Y-shaped fiber support and a light-gathering fiber. The light-gathering fiber comprises a length of fiber optic material with a sighting point on each distal end thereof. The offset-Y-shaped fiber support is an offset-Y-shaped member whose offset allows for placement in either of two spaced arcuate channels while maintaining the targeting axis position of the sighting points. The guard, which encircles the sight pins, includes three fiber optic fibers spaced about its diameter to allow for low-light alignment.

11 Claims, 2 Drawing Sheets

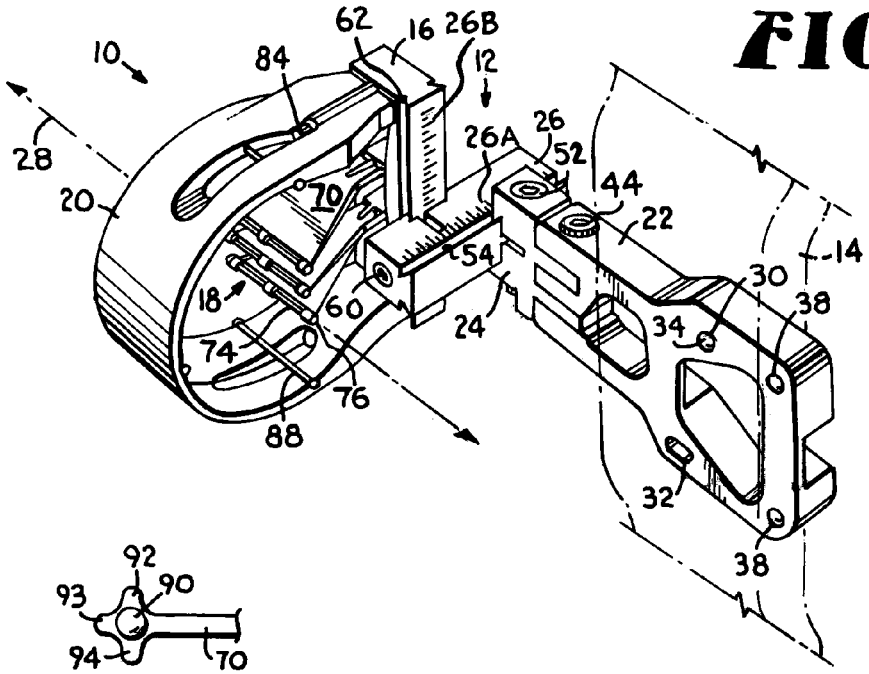
FIG. 1.
FIG. 8.
FIG. 2.
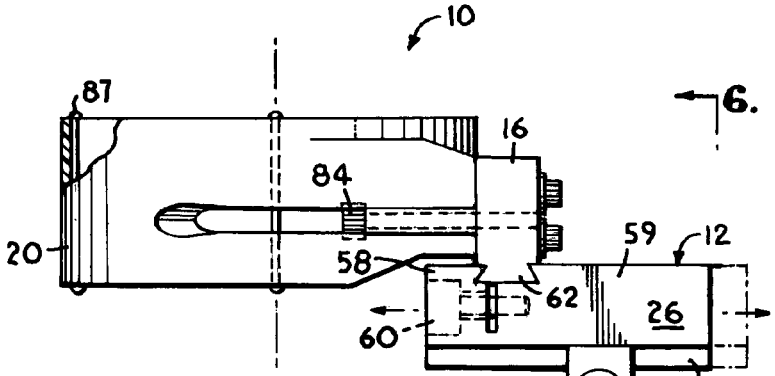
FIG. 3.
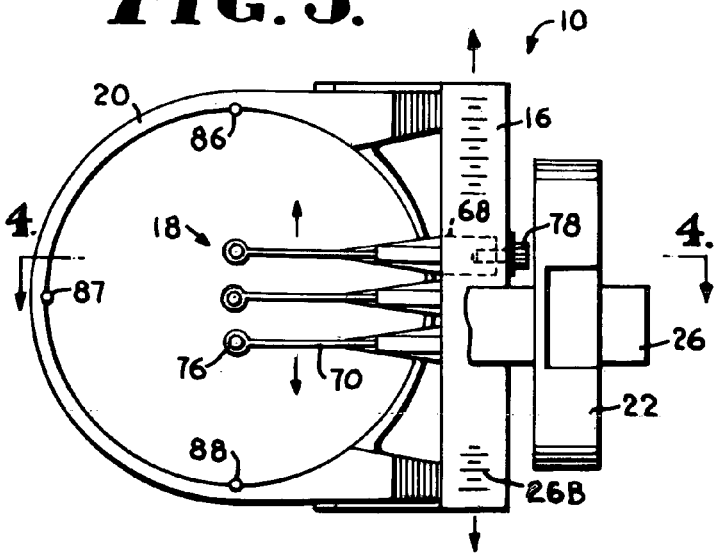

SIGHT AND SIGHT PINS FOR ARCHERY BOW

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to a device used to facilitate the accurate shooting of an archery bow. More particularly, the invention relates to a sighting device comprising a sight structure and sight pins. Bow sights typically consist of a support structure used to secure a sighting device to a bow and a plurality of vertically spaced sight points attached to horizontal pins. Each of the different sight points represent distinct target ranges. By selecting the appropriate pin and sight point for a given range, the archer can accurately aim his arrow for a specified target distance.

The use of a bow for hunting or target practice often occurs in low-light conditions when visibility of a sight point is critical. Various sighting devices have been developed to gather ambient light to improve visibility of sight points. A typical device will employ a light-emitting fiber optic material to generate a sight point. However, the prior art devices suffer from a number of deficiencies. First, the prior art devices either fail to support and maintain the fiber optic strand in a strait line along its entire length. Whenever a light-gathering fiber is bent, light leaks out resulting in a dimmer sight point. Moreover, any portion of the delicate light-gathering fiber extending outside the support is subject to potential breakage. Thus, a sight pin that supports the light-gathering fiber along its entire length and in a strait line is advantageous.

Second, the prior art sighting devices fail to compensate for the vertical spacing of the numerous sight pins. For maximum aiming accuracy, a sight point of a sight pin should be aimed directly at the archer's eye such that the archer does not need to look slightly up or slightly down at the desired sight point. In other words, when aiming, the archer should see only the sight points and no other profile of the sight pins. Thus, a sight structure that compensates for the vertical dispensation of various sight points and ensures that all points are aimed directly at the archer's eye possesses significant advantages.

Third, prior art devices fail to provide a centering system for low-light usage. Sight structure typically includes a sight pin guard. When using prior art devices, archers have had to choose between utilizing a small peep for accuracy or a larger peep for greater visibility in low-light conditions. Thus, a sight structure including a guard that possesses illuminating features to allow for low-light centering would possess novel and advantageous characteristics.

Accordingly, there remains a need for a sighting device that provides a sight pin that supports a fiber optic light-gathering fiber along its entire length and in a strait line, a sight structure that compensates for the vertical dispensation of various sight points and ensures that all points are aimed directly at the archer's eye, and that provides a centering system for low light usage. The present invention fills these needs as well as various other needs.

BRIEF SUMMARY OF THE INVENTION

In order to overcome the above-stated problems and limitations, and to achieve the noted objects, there is provided a novel sighting device that may be used for aiming an archery bow.

In general, the sighting device includes a sighting assembly and a mounting assembly. The sighting assembly includes a base, a guard, and one or more sight pins. The mounting assembly is slidingly engaged to the base such that the position of the sighting device may be vertically adjusted relative to the bow. Moreover, the mounting assembly is horizontally adjustable such that the position of the sighting device may be horizontally adjusted relative to the bow. Measuring markings are provided on both the mounting assembly and the base to ensure accurate placement of the sighting device relative to the bow such that the sight points may be placed in a location preferred and selected by the archer. The mounting assembly is secured to the bow by use of screws or bolts that are inserted into the bow through bolt holes in the mounting member. In addition to bolt holes, the mounting member also includes a bolt slot. The slot allows the archer to adjust the directional alignment of the sight pins through a slight rotation of the mounting member about the horizontal axis of the bow. The mounting assembly further includes a two-screw locking feature that allows the sighting device to be adjusted along the targeting axis to further ensure proper directional alignment of the sight pins with the archer's eye-line and that further allows the sighting device to be locked in position once a desired pin alignment is achieved.

The base of the sighting assembly includes arcuate channels sized for receipt of the sight pins. The arcuate channels define an arc with a radius substantially equivalent to the arm reach of the archer and with a center point at the archer's eye. By this structure, the sight pins, which are spaced vertically along the base are aimed directly at the archer's eye regardless of the vertical spacing of the pins. In other words, the archer is looking directly at an appropriate sight pin for a selected targeting range, as opposed to looking up or down at the pin. The arcuate channels are spaced along the targeting axis of the sighting device.

The guard is removably fixed to the base. The guard is generally shaped to encircle the targeting axis of the sight pins and thereby offers protection to the sight pins. The guard includes a plurality of light-gathering fibers spaced about the outer diameter of the guard. The fibers provide points of reference by which the archer may center or align the sighting device by reference to the field of sight of the peep. Moreover, the fibers allow the archer to utilize a large peep in low-light conditions.

The sight pins include a light-gathering fiber and an offset-Y-shaped fiber support. The light-gathering fiber comprises a length of light-gathering fiber optic material. The entire length of the fiber is maintained in a straight line along the targeting axis. The offset-Y-shaped fiber support is defined by a clasped end and a cubed end. The cubed end is a cube shaped segment which is sized for a mating engagement in either of the arcuate channels of the base. The clasped end of the offset-Y-shaped fiber support is sized to support the entire length of the light-gathering fiber. From cubed end to clasped end, the offset-Y-shaped fiber support takes on a offset-Y-shaped configuration. The offset dimension is equivalent to the spacing between the arcuate channels such that by rotating the offset-Y-shaped fiber support 180 degrees about its longitudinal axis, the sight pins may be placed in either of the arcuate channels while maintaining the targeting axis position of the sight points. The sighting points are located at each distal end of each light-gathering fiber and are of larger diameter than the remainder of the fiber. Additionally, an enhanced sighting point may be provided at each distal end of the light-gathering fiber to enhance intermediate range targeting ability and to provide the archer with more precise means for directionally aligning the sight pins, i.e., for discerning either unwanted torqueing or canting of the bow.

Further objects, features, and advantages of the present invention over the prior art will become apparent from the detailed description of the drawings which follow, when considered with the attached figures.

BRIEF DESCRIPTION OF THE SEVERAL VIEWS OF THE DRAWINGS

In the accompanying drawings which form a part of the specification and are to be read in conjunction therewith and in which like reference numerals are employed to indicate like parts in the various views:

FIG. 1 is an environmental view showing a first embodiment of a device of the present invention as it would be attached to a bow in use;

FIG. 2 is a top plan view of the device;

FIG. 3 is a front plan view of the device from the archer's perspective;

FIG. 8 is an fragmentary elevation view of a second embodiment of a sight pin detailing intermediate aiming points.

DETAILED DESCRIPTION OF THE INVENTION

Figure 4:
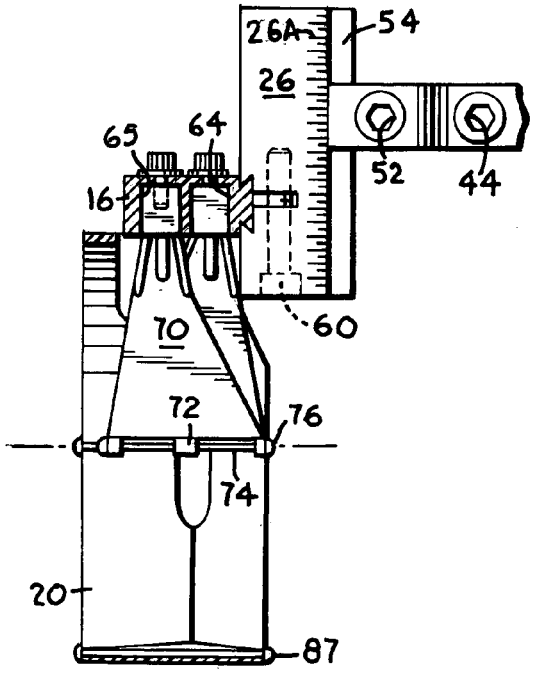
FIG. 4 is a cross-sectional view of the device taken along line 4—4 in FIG. 3.

Referring now to the drawings in detail, and initially to FIG. 1, numeral 10 generally designates a sighting device constructed in accordance with a first embodiment of the present invention. As best seen in FIG. 3, device 10 generally includes a sighting assembly including a base 16, sight pins 18, and a guard 20. As best seen in FIG. 2, device 10 also includes a mounting assembly 12 for attaching the sighting assembly to a bow.

As best seen in FIG. 1, the mounting assembly 12 includes a bow-mount portion 22 and a horizontal beam 26. For point of reference, the targeting axis defines a targeting axis line 28. The horizontal beam 26 of the mounting assembly 12 includes a horizontal beam channel 62 that is slidingly engaged to base 16. The horizontal beam channel 62 is secured to base 26 by tightening of horizontal beam locking screw 60. This arrangement allows for vertical adjustment of the sighting assembly relative to the bow. The bow mount portion 22 further includes locking screw 44. The bow mount channel 24 pivots relative the rest of bow mount portion 22 about locking screw 44. Several interlocking teeth 40, 41, 42, 46, and 47 are all intersected by locking screw 44. The interlocking teeth provide for a consistent fit between the bow mount channel 24 and the remainder of the bow mount portion 22 about the pivot point. Additionally, the bow-mount portion 22 of the mounting assembly 12 includes a bow-mount channel 24 that is slidingly engaged to the horizontal beam 26 by dovetail slide 54 extending the length of the horizontal beam 26. Bow-mount channel 24 is secured to horizontal beam 26 by tightening of bow-mount portion locking screw 52. This arrangement allows for horizontal adjustment of the sighting assembly relative to the bow. The horizontal beam 26 provides measurement markings 26A for accurate positioning of the sighting assembly in the horizontal direction. The markings 26A allow the archer to repetitively place the sighting assembly in a favored position for a given target range. Similarly, base 16 provides measurement markings 26B for accurate and/or repetitive positioning of the sighting assembly in the vertical direction.

Figure 6:
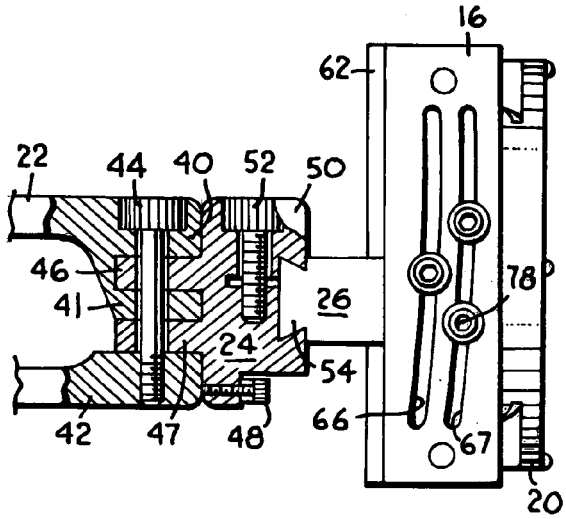
FIG. 6 is a cross-section view of the device taken along line 6—6 in FIG. 2.

As best seen in FIG. 6, mounting assembly 12 also includes targeting axis lock 48. A first embodiment of lock 48 comprises a pair of horizontally spaced screws which may be tightened to apply pressure to the bow-mount portion 24 of the mounting assembly 12 and thereby allows the archer to adjust the targeting axis orientation of the sight pins. In use, the sight pins should be aimed directly along the archer's eye-line and the archer should see only a sighting point and not a profile of the pin while attempting to aim. Any profile view blocks a portion of the targeting area and inhibits accurate aiming. To prevent potential misalignment, the archer may adjust the targeting axis alignment of the sight pins by tightening the targeting axis lock 48 in a desired position. Moreover, the lock 48 allows the archer to maintain a consistent targeting axis orientation to account for any consistent canting of the bow.

Finally, mounting assembly 12 is attached to a bow 14 by securing the bow-mount portion 22 of said mounting assembly 12 to a bow 14 utilizing a plurality of bolt holes 38 and 30 and an elongated bolt slot 32. Bolts 34 and 36 are received in apertures 30 and 38 for attachment to the bow 14. Bolt slot 32 provides an additional means for targeting axis alignment. As noted previously above, when properly aligned, the archer should be able to see only sighting point 76 or 70 without seeing any other profile view of the sight pin. In other words, the light-gathering fiber 74 should lie entirely along the targeting axis 28 or the archer's sight-line. To facilitate this proper alignment, bolt slot 32 allows the archer to slightly rotate the mounting assembly 22 about the horizontal axis of the sighting device, i.e., the mounting assembly's targeting axis orientation may be slightly altered to ensure that the entire length of the light-gather fibers 74 lie along the targeting axis. This adjustment is performed by altering the position of a bolt along slot 32.

Figure 7:
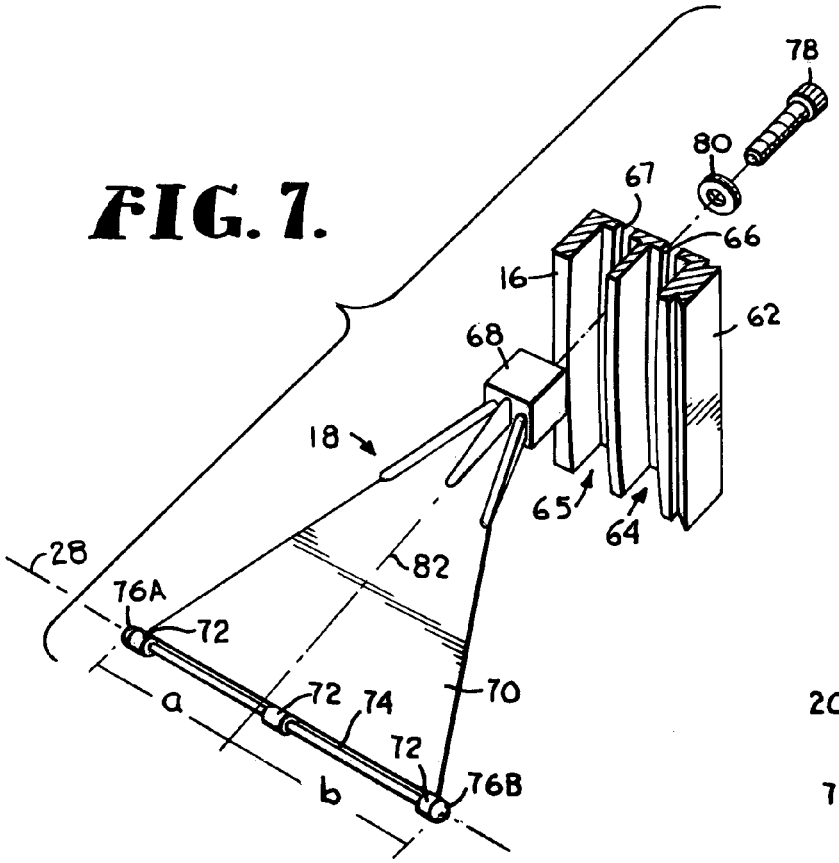
FIG. 7 is an exploded view of a first embodiment of a sight pin detailing a preferred means for connection of said sight pin to a base within arcuate channels.
Figure 5:
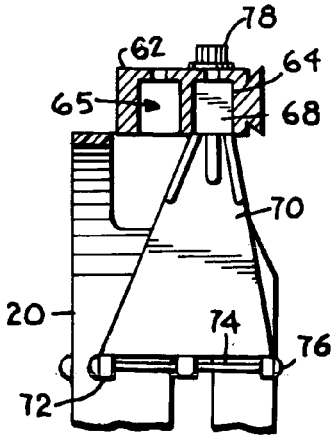
FIG. 5 is a top plan view of the device with support structure omitted.

As best seen in FIG. 6, a first embodiment of base 16 includes two arcuate channels 66 and 67. As best seen in FIG. 7, arcuate channels 64 and 65 are sized for receipt of a sight pin 18. As best seen in FIG. 3, during use of sighting device 10, a plurality of sight pins 18 may be inserted in either arcuate channel 64 or 65 and spaced vertically along base 16. When using the sighting device, the individual sight pins 18 are spaced vertically at a predetermined level along base 16. Each distinct vertical placement of the sight pin 18 typically represents distinct target distances from which the archer can select in the aiming of his arrow toward an intended target.

As seen in FIG. 7, each sight pin 18 includes a light-gathering fiber 74 and an offset-Y-shaped fiber support 70. As seen in FIG. 1, each light-gathering fiber 74 defines a targeting axis 28. In use, the targeting axis 28 should extend from the archer's eye along the light-gathering fiber 74 to the intended target. To improve shooting accuracy, each light-gathering fiber 74 when selected for a given target range should substantially align with the targeting axis 28. The present device provides for proper alignment of light-gathering fiber 74 and targeting axis 28 regardless of the vertical placement of sight pin 18 along base 16. This advantage is accomplished by use of arcuate channels 66 and/or 67. Arcuate channels 66 and 67 each define an arc with a radius substantially equivalent to the arm length of the archer with a center point at the archer's eye. Each sight pin 18 is secured to base 16 such that each light-gathering fiber 74 is oriented perpendicular to or along the radius of the arc defined by arcuate channels 66 and 67. As a result of this configuration, the light-gathering fiber 74 is always aimed directly at the archer's eye regardless of the sight pin's 18 vertical placement along base 16. Thus, the precise alignment of the entire length of the light-gathering fiber 74 along the intended targeting axis 28 is maintained without adjusting the targeting axis orientation of sight pins 18 for every desired target range and without regard to the vertical position of sight pin 18.

As best seen in FIG. 2, guard 20 is attached to base 16 by use of guard attachment screws 84. Guard 20 defines a circle enclosing and protecting sight pins 18. Where a sight pin 18 is centered along the vertical axis of base 16, the light-gathering fiber 74 of that sight pin 18 is located substantially at the center of the circle defined by guard 20. As best seen in FIG. 4, the width of guard 20 is slightly less than the longitudinal length of light-gathering fiber 74. As depicted in FIG. 3, guard 20 includes three centering fibers 86, 87, and 88 located on the diameter of the circle defined by guard 20. The centering fibers allow the archer to adjust his/her position relative to the sighting assembly to obtain proper alignment between the archer and sight pins 18. The centering fibers 86, 87, and 88 are more specifically located at 0°, 180°, and 270° about the circle defined by guard 20. Centering fibers 86, 87, and 88 each comprise a light-gathering fiber with an illuminating point at each distal end thereof. This allows the archer to visualize the outer diameter of guard 20 for centering purposes in low-light conditions. The centering occurs when an archer utilizes any of a variety of sighting peeps which are widely known in the art. When the archer sights through a peep and is not properly positioned relative to the sighting assembly, then the peep will cover up one of the centering fibers 86, 87, and 88 on guard 20. For example, if the archer is positioned too high relative to the sighting assembly, then the peep will obscure the archer's view of the centering fiber 86 located at 0°. Thus, when an archer is properly positioned and sights through the peep, he/she should see all centering fibers 86, 87, and 88. When all centering fibers 86, 87, and 88 are seen through the peep, the archer is assured of centered positioning relative to the sighting assembly. Moreover, the use of centering fibers 86, 87, and 88 allow the archer to utilize a large peep that lets in more light in low-light conditions. Archers typically use a small peep for enhanced accuracy. However, with the centering system provided by centering fibers 86, 87, and 88, an archer may use a larger peep and still maintain excellent accuracy. This is advantageous when shooting in low-light conditions.

As best seen in FIG. 7, sight pins 18 generally include a light-gathering fiber 74 and an offset-Y-shaped fiber support 70. When sight pin 18 is properly affixed to base 16, the longitudinal axis of light-gathering fiber 74 lies on the targeting axis 28. Light-gathering fiber 74 comprises a light-gathering fiber optic material defined by a longitudinal length, a first distal end and second distal end, and a tubular diameter. Each distal end of light-gathering fiber 74 comprises a sighting point 76A and 76B with a diameter greater than the diameter along the length of the fiber. The fiber is of a composition characterized as light-gathering along its length to conduct and focus light at sighting points 76A and 76B.

In an alternative embodiment depicted in FIG. 8, the clasps 72 attached to each distal end of light-gathering fibers 74 form a star-shaped enhanced sight point 92, 93, and 94. Enhanced sight points 92, 93, and 94, as noted above, also serve as a clasp to attach the light-gathering fibers 74 to the clasped end 72 of the offset-Y-shaped support member 70. Enhanced sight points 92, 93, and 94 are defined by a top intermediate aiming point 92 and a bottom intermediate aiming point 94. The top intermediate aiming point 92 and bottom intermediate aiming point 94 allow the archer to target intermediate ranges slightly farther or shorter than the range provided by the center of the sighting point 90. For example, if sighting point 90 were sighted in for a target range of 30 yards, then bottom intermediate aiming point 94 might provide a range of 33 yards and top intermediate aiming point 92 might provide a range of 27 yards. Enhanced sight points 92, 93, and 94 provide an additional advantage to the archer. Because top 92 and bottom 94 intermediate aiming points are located at each distal end of light-gathering fibers 74, the archer may align the respective points to ensure that the bow is not torqued or twisted about its vertical axis. When properly aligned, the archer should see only the intermediate aiming points 92 and 94 located on the distal end of light-gathering fiber 74 nearest the archer. If the bow is torqued even slightly, then the intermediate aiming points 92 and 94 at the farther distal end will become visible. In other words, proper alignment about the vertical axis is maximized by reference to the alignment of distally opposing intermediate aiming points 92 and 94 such that only one set of intermediate aiming points is visible to the archer. Moreover, the distally opposing horizontal aiming points 93, again located at each distal end of light-gathering fiber 74, can be aligned to prevent canting or tipping of the bow. When only the horizontal aiming point 93 at the distal end nearest the archer is visible, the archer can be assured that the bow is not canted or tipped about the horizontal axis. The prevention of both torqueing and canting are essential to maintaining the targeting axis orientation of the sight pins and thereby maximizing the accurate utilization of the sighting device.

Again referencing FIG. 7, light-gathering fiber 74 is supported along its entire length by offset-Y-shaped fiber support 70. Offset-Y-shaped fiber support 70 is defined by a clasped end 72 and a cubed end 68. Axis 82 identifies the axis line extending from the center of cubed end 68 along the offset-Y-shaped fiber support 70. Clasped end 72 of offset-Y-shaped fiber support 70 abuts light-gathering fiber 74 along its entire length. Light-gathering fiber 74 is fixed to clasped end 72 by the application of three clasps. The full-length support of light-gathering fiber 74 is important for several reasons. First, any bending of the light-gathering fiber 74 will result in loss of light, resulting in dimmer sighting points 76A and 76B. By maintaining the straight-line orientation of light-gathering fiber 74, the focused light at sighting points 76A and 76B will be maximized. Second, by maintaining the straight-line orientation of light-gathering fiber 74 along targeting axis 28, the archer will be able to see only sighting points 76A or 76B and aiming will not be distracted by the remainder of light-gathering fiber 74. Finally, full-length support of light-gathering fiber 74 provides added durability and prevents breakage of the fiber.

As best seen in FIG. 7, offset-Y-shaped fiber support 70 includes a clasped end 72 and a cubed end 68. The cubed end 68 defines a cube shape. The longitudinal axis of offset-Y-shaped fiber support 70 passes through the center of the cube defined by cubed end 68. As seen in FIG. 7, sighting point 76B is nearer the longitudinal axis of offset-Y-shaped fiber support 70 than sighting point 76A. Thus, an offset is present in the Y-shape of offset-Y-shaped fiber support 70. This offset allows the archer to use both arcuate channels 64 and 65 in base 16 while ensuring that all sighting points are equidistant from the archer along the targeting axis of each light-gathering fiber 74. For example, if the archer wishes to insert a sight pin 18 in arcuate channel 64, then he/she would orient sight pin 18 such that sighting point 76B were nearest the archer. If the archer wished to insert another component in arcuate channel 65, then he/she would orient sight pin 18 such that sighting point 76B were nearest the archer. If assembled according to these examples, then sighting points 76B of the two distinct sight pins 18 would be equidistant from the archer. The offset of offset-Y-shaped fiber support 70 thus allows sight pin 18 to be used in either arcuate channel 64 or 65. The offset-Y-shape provides the added benefit of making sight pins 18 reversible about their longitudinal axis which is advantageous should sighting point 76A or 76B become damaged.

As best seen in FIG. 7, sight pin 18 is attached to base 16 within arcuate channel 66 or 67. The cubed end 68 of offset-Y-shaped fiber support 70 is sized for receipt within arcuate channel 64 or 65. The mating engagement of cubed end 68 and base 16 within arcuate channel 64 or 65 results in sight pin 18 being cantilevered horizontally from base 16 with light-gathering fiber 74 of sight pin 18 being oriented along the targeting axis and perpendicular to the arc defined by arcuate channels 64 and 65. Sight pin 18 may be secured to sighting device 10 at base 16 by utilizing a washer 80 and screw 78 combination. Screw 78 passes through washer 80, through an opening in arcuate channel 66 or 67 and is received by cubed end 68 of offset-Y-shaped fiber support 70. Additionally, sight pin 18 may be secured to sighting device 10 at base 16 by friction fit, adhesive, or other similar securement mechanisms.

It can, therefore, be seen that the invention is one that is designed to overcome the drawbacks and deficiencies existing in the prior art. While particular embodiments of the invention have been shown, it will be understood, of course, that the invention is not limited thereto, since modifications may be made by those skilled in the art, particularly in light of the foregoing teachings. Reasonable variation and modification are possible within the scope of the foregoing disclosure of the invention without departing from the spirit of the invention.

What is claimed is:

1. A sighting device for use with an archery bow comprising:

a base having at least two arcuate channels and at least two sight pins defining a targeting axis and attached to said base within said arcuate channels, wherein the sight pins each comprise an offset-Y-shaped fiber support and a light-gathering fiber defining a targeting axis, said sight pins being individually affixed to said base within said arcuate channels such that the targeting axis of said light-gathering fiber is oriented perpendicular to the arc defined by said arcuate channels, said arc having a radius substantially equivalent to the arm length of said bow's user and a center point at said user's eye.

2. The sighting device of claim 1, wherein said arcuate channels within said base are sized for receipt of said sight pins and wherein the arc defined by said arcuate channels has a radius substantially equivalent to the arm length of said bow's user and a center point at said user's eye.

3. The sighting device of claim 1, wherein said base is measurably marked for accurate location of said sight pins.

4. A sight pin for use in a sighting device comprising:

a light-gathering fiber wherein said fiber defines a targeting axis, an offset-Y-shaped fiber support for supporting said light-gathering fiber throughout its length and for preventing any bending or deviation of said light-gathering fiber from its targeting axis, said support including a plurality of support members spaced along the fiber and with at least one support member positioned at each end of the light-gathering fiber, means for attaching said sight pin to said sighting device.

5. The sight pin of claim 4, wherein said light-gathering fiber is defined by a longitudinal length oriented in a straight line on said targeting axis, a first distal end and second distal end, and a tubular diameter.

6. The sight pin of claim 5, wherein said light-gathering fiber is further defined by a first sighting point and a second sighting point located, respectively, at said first distal end and said second distal end of said light-gathering fiber.

7. The sight pin of claim 4, wherein said offset fiber support is defined by a clasped end and a cubed end wherein said clasped end engages said longitudinal light-gathering fiber along its targeting axis and said cubed end is sized for receipt within said sighting device and wherein said offset fiber support is further defined by a longitudinal axis passing horizontally through the center of said cubed end.

8. The sight pin of claim 7, wherein said clasped end of said offset fiber support is horizontally spaced to support the entire length of said light-gathering fiber along said targeting axis.

9. The sight pin of claim 7, wherein said offset fiber support is adapted for use in a sighting device having a first and second channel for receipt of said offset fiber support, said channels being offset in relation one to the other along said targeting axis of said light-gathering fiber, said light-gathering fiber being defined by a first and second sighting point.

10. The sight pin of claim 9, wherein said offset fiber support may be received in either of said offset first and second channels while maintaining said first and second sighting points of said light-gathering fiber at a constant position along said targeting axis, said offset of said offset fiber support corresponding in dimension to the targeting axis offset of said first and second channels such that rotating said offset fiber support 180 degrees about its longitudinal axis will maintain the targeting axis position of said first and second sighting points of said light-gathering fiber regardless of the channel by which said offset fiber support is received.

11. A sight pin for use in a sighting device comprising:

a light-gathering fiber with a distal end wherein said distal end forms a sight point, a fiber support with a clasp at the distal end of said fiber for securing said fiber to said fiber support, wherein said clasp is shaped to define intermediate aiming points extending outwardly from said sight point to allow intermediate range sighting and directional alignment of said pin, and means for attaching said sight pin to said sighting device.

* * * * *